US005134443A

United States Patent [19]

Sumi et al.

[11] Patent Number: 5,134,443

[45] Date of Patent: Jul. 28, 1992

[54] CONVEYING UNIT OF IMAGE-FORMING MACHINE

[75] Inventors: Hiroshi Sumi; Yoshiyuki Asakawa, both of Osaka, Japan

[73] Assignee: Mita Industrial Co., Ltd., Osaka, Japan

[21] Appl. No.: 579,610

[22] Filed: Sep. 7, 1990

[30] Foreign Application Priority Data

Sep. 14, 1989 [JP] Japan ..... 1-239687
Sep. 19, 1989 [JP] Japan ..... 1-243081

[51] Int. Cl.[5] ..... G03G 21/00

[52] U.S. Cl. ..... 355/309; 355/200; 355/271

[58] Field of Search ..... 355/200, 205, 207, 210, 355/211, 271, 274, 308, 309

[56] References Cited

U.S. PATENT DOCUMENTS 4,165,168 8/1979 Baumann et al. ..... 355/200
4,531,823 7/1985 Deguchi et al. ..... 355/308
4,627,711 12/1986 Schron ..... 355/208
5,043,770 8/1991 Nagaro et al. ..... 355/309 X

FOREIGN PATENT DOCUMENTS 0297917 1/1989 European Pat. Off. .

OTHER PUBLICATIONS

Patent Abstracts of Japan, vol. 13, No. 57, (P-825) [3405], Feb. 9, 1989 for Japanese Patent No. JP-A-63 246 755.

*Primary Examiner*—A. T. Grimley
*Assistant Examiner*—Christopher Horgan
*Attorney, Agent, or Firm*—Beveridge, DeGrandi & Weilacher

[57] ABSTRACT

The main body of the image-forming machine is provided with an image-forming unit and a conveying unit disposed opposite to the image-forming unit. The conveying unit supports a mounting and detaching unit so that it is selectively movable to a set position or a non-set position. A locking means is provided between the mounting and detaching unit and the main body of the image-forming machine. When the mounting and detaching unit is held at the non-set position, the lock means is cancelled, and the conveying unit can be drawn from the main body of the image-forming machine. As a result, a large space is created beneath the image-forming unit, and jamming can be easily disposed of.

15 Claims, 12 Drawing Sheets

CONVEYING UNIT OF IMAGE-FORMING MACHINE

FIELD OF THE INVENTION

This invention relates to a conveying unit to be used in an image-forming machine such as a copying machine and a printing machine.

DESCRIPTION OF THE PRIOR ART

In an image-forming machine such as an electrostatic copying machine, a structure comprising an image-bearing member, for example an image-forming unit provided with a rotating drum, and a conveying unit disposed beneath the image-forming unit is known.

In the image-forming unit, around the image-bearing member are provided a cleaning device, a charge eliminating lamp, a charging device, a blank lamp, a developing device and one of pair of rollers for paper feeding. The conveying unit has provided therein the other of the pair of rollers for paper feeding, transferring and separating charging devices, and conveyor belt devices.

Paper for copying sent from a table or a cassette by a paper feeding roller passes between the image-forming unit and the conveying unit, and after the image is transferred thereto, the paper is conveyed to a fixing device, and the image is fixed. When in such a paper passing step, paper jamming occurs, the conveying unit is brought down in a downward direction, that is, in a direction apart from the image-forming unit, to form a space between the conveying unit and the image-forming unit, and the jamming is disposed of.

To dispose of the jamming in conventional copying machines, the above space cannot be created widely depending upon the copying machines, and it is very difficult to remove the jammed paper, and this operation should be performed by inserting the hand from a very narrow space. Hence, there is a risk of getting the hand injured. Furthermore, since the conveying unit is positioned in proximity to the fixing device and constructed such that it pushes down the driving shaft of the conveyor belt device, if the paper bites into the fixing device, there is little space in that part, and the operability of disposing of the jamming operation becomes further worse. On the other hand, when the conveying unit itself is to be maintained, it must be removed every time, and this operation is very inconvenient.

SUMMARY OF THE INVENTION

It is therefore a main object of this invention to provide a conveying unit of an improved image-forming machine in which it is very easy to perform an operation of disposing of jamming.

This object of the invention is achieved by a conveying unit in an image-forming machine comprising an image-forming unit supported on the main body of an image-forming machine and a conveying unit disposed opposite to the image-forming unit, said conveying unit being supported on the main body of the image-forming machine in such a manner that it can be drawn from the main body of the image-forming machine, a mounting and detaching unit being selectively movably supported between a setting position and a non-setting position with respect to the image-forming unit, and a locking means positioned between the mounting and detaching unit and the main body of the image-forming machine, said locking means interlocking with the said selective movement of the mounting and detaching unit and hampering and permitting the movement of the conveying unit in a drawing direction.

The other objects and features of this invention will become apparent from the detailed description of the invention made with reference to the accompanying drawings.

DETAILED DESCRIPTION OF PREFERRED EMBODIMENTS

With reference to the accompanying drawings, the conveyor unit of the image-forming machine improved by the invention will be described on the basis of specific embodiments.

Figure 1:
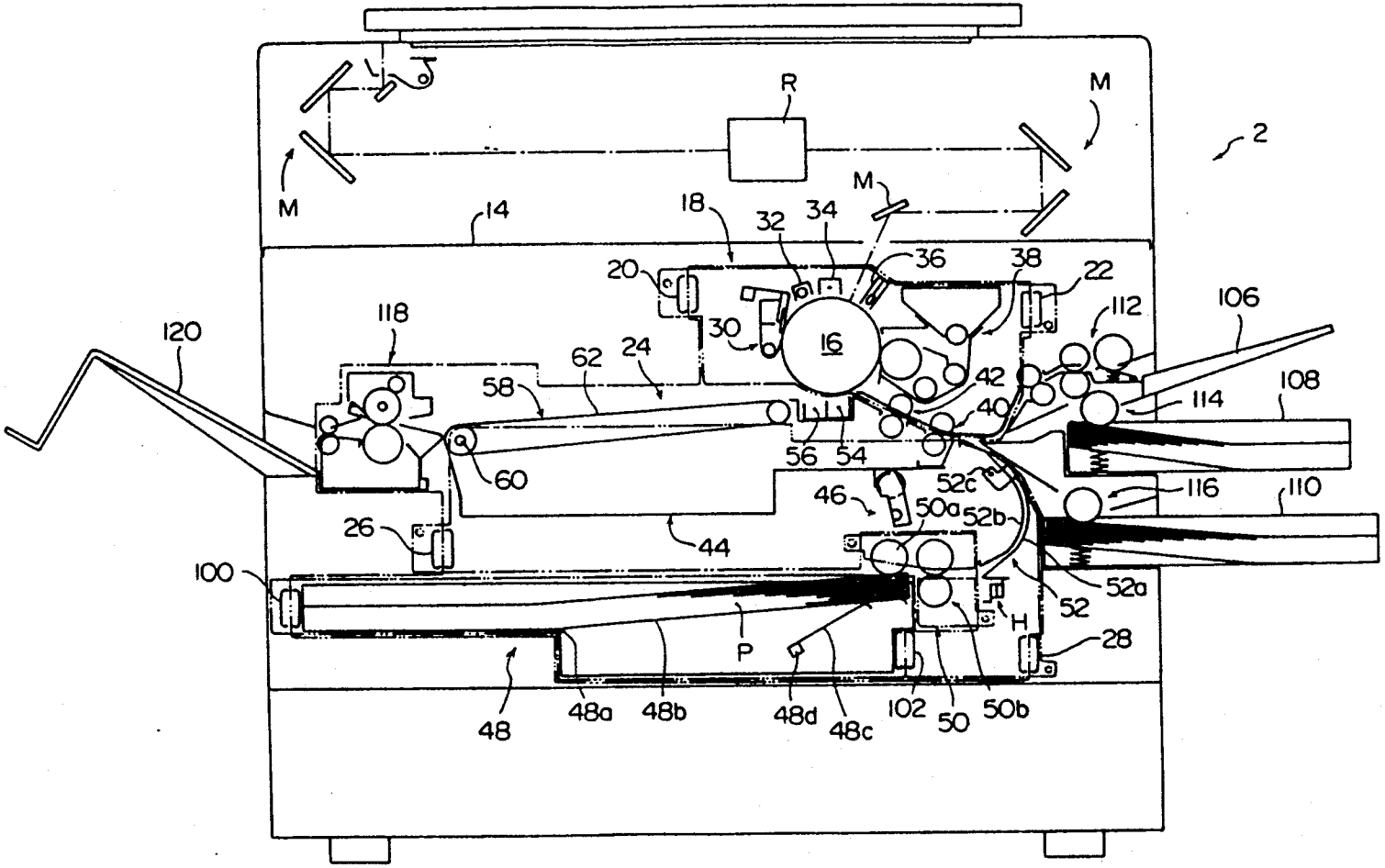
FIG. 1 is a simplified sectional view of an electrostatic copying machine including one embodiment of this invention.
Figure 2:
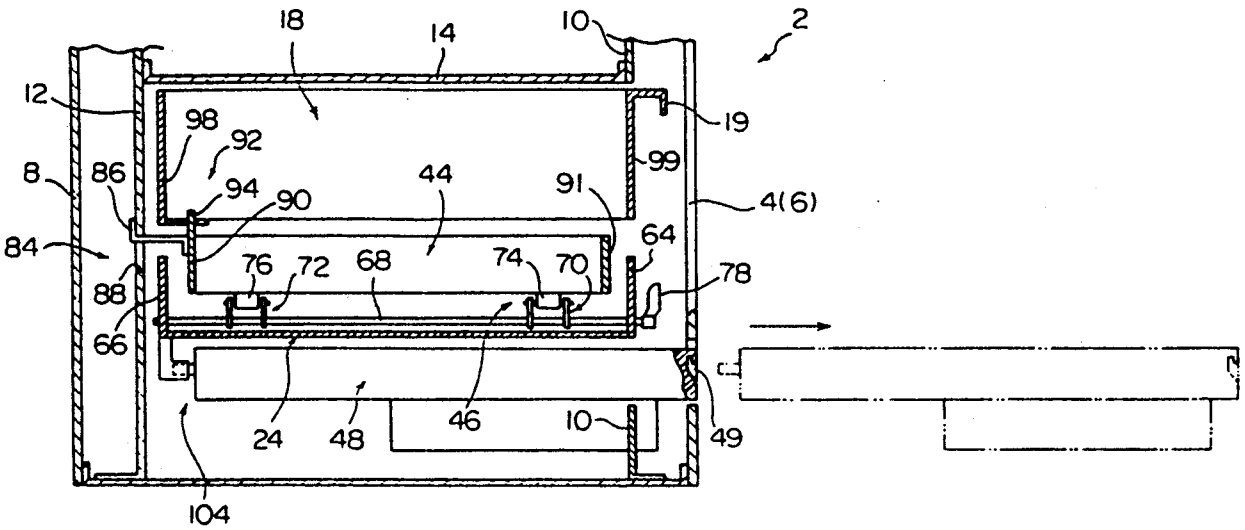
FIG. 2 is a rough view of the vertical section of principal parts of FIG. 1.
Figure 11:
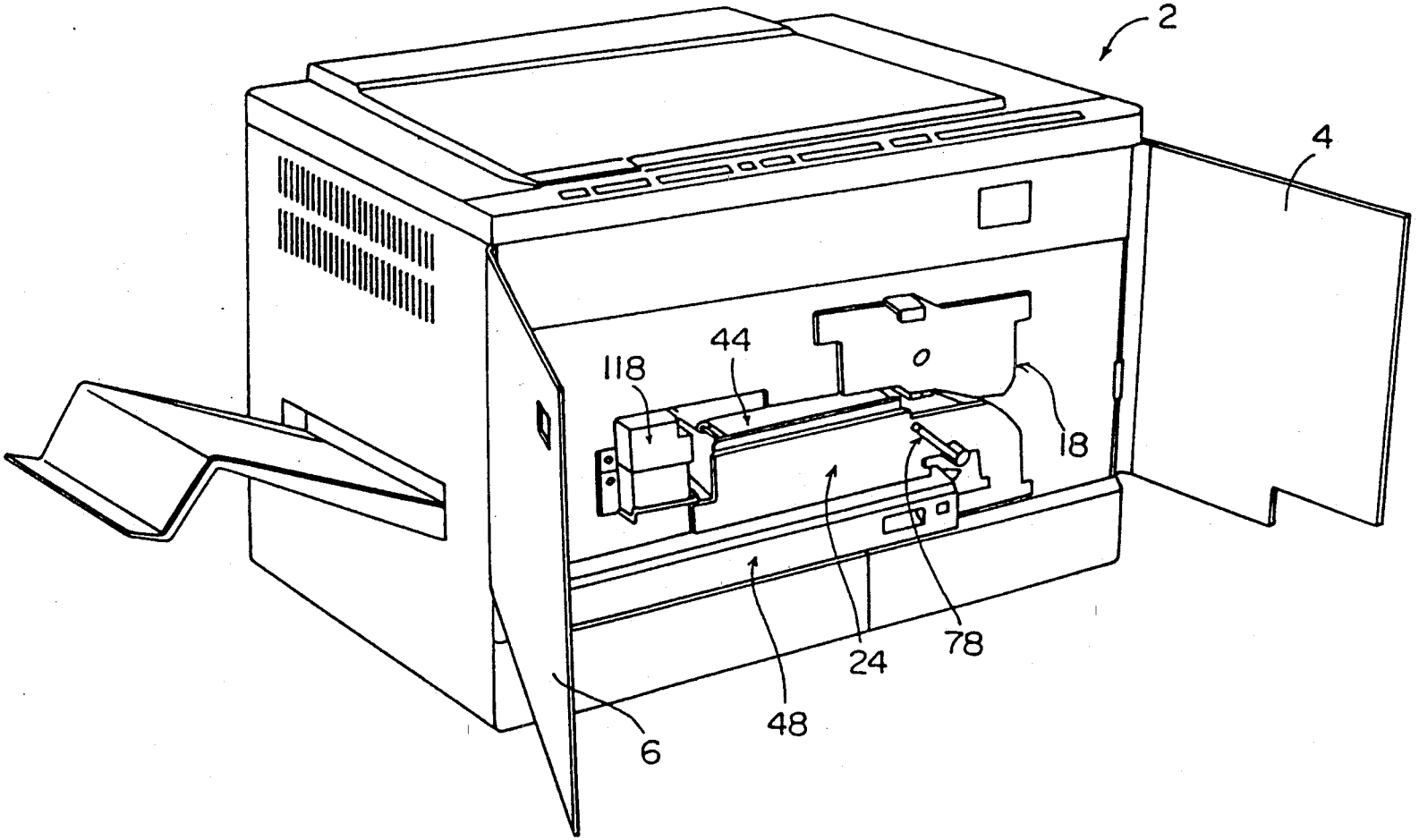
FIG. 11 is a perspective view showing an embodiment of actions in FIG. 1.

In FIGS. 1 and 2 showing one embodiment of the electrostatic copying machine (to be simply referred to as a copying machine) equipped with the conveying unit in accordance with this invention, the copying machine has a nearly cube-shaped housing generally shown at 2. In the housing 2 which is a main body of the copying machine, front covers 4 and 6 (see FIG. 11) which open frontwardly of the user of the copying machine, a rear cover 8, front side plates 10 disposed inwardly of the front covers 4 and 6, a rear side plate 12 disposed in front of the rear cover 8, and a horizontal base plate 14 disposed at the upper portion in the housing 2 and partitioning the inside of the housing vertically. The above-mentioned covers (4, 6) and the front and rear side plates (10, 12) are disposed so as to extend vertically. The horizontal base plate 14 is provided between the front side plate 10 and rear side plate 12.

The upper space resulting from partitioning the housing 2 by the horizontal base plate 14 has provided therein known optical device composed of a lens device R and reflexing mirrors M in relation to an image-bearing member 16 composed of a rotating drum, which will be described later.

In the lower space of the housing 2 resulting from partitioning by the horizontal base plate 14, an image-forming unit 18 including an image-bearing member, namely an image-bearing member 16 composed of a rotating drum in the embodiment, is supported so that it may be drawn alone to the front of the copying machine by a known pair of parallel slide rails (for example, Aculide rails, a trademark) 20 and 22. At lower positions facing the image-forming unit 18, the conveyor unit 24 is supported so that it can be drawn to the front of the copying machine by a pair of parallel slide rails 26 and 28 like those described above.

Around the image-bearing member 16 of the image-forming unit 18 there are provided a cleaning device 30, a charge-eliminating lamp 32, a charger 34, a blank lamp 36, a developing device 38 and the upper rollers of a pair of paper-feeding rollers 40 and 42. These devices and means are provided between the rear side plate 98 and the front side plate 99 (see FIG. 2) of the image-forming unit 18.

In conveyor unit 24 are provided a mounting and detaching unit 44, a mounting and detaching means 46, a paper feeding unit 50 and a pair of guide plates (guide plate pair) 52.

The mounting and detaching unit 44 is provided with the lower rollers of a pair of paper feeding rollers 40 and 42 provided at a lower position facing the image-forming unit 18, a transferring charger 54 and a separation charger 56 provided at a lower position facing the image-bearing member 16 and a conveyor belt device 58 which is a paper conveying means provided at a downstream side of each charger. These devices and means are provided between a rear side plate 90 and a front side plate 91 (see FIG. 2) of the mounting and detaching unit 44. The conveying belt device 58 is known per se, and includes a driving shaft 60 disposed on its most downstream side. The driving shaft 60 is driven by a driving means (not shown) to move a belt 62 interlocking with it in the paper conveying direction. The mounting and detaching unit 44 is supported by a conveying unit 24 through the driving shaft 60. The mounting and detaching unit 44 is constructed such that using the driving shaft 60 as a fulcrum, it can be moved selectively up and down to a set position predetermined with respect to the image-forming unit 18 and to a non-set position separated downwardly from the image-forming unit 18.

Figure 3:
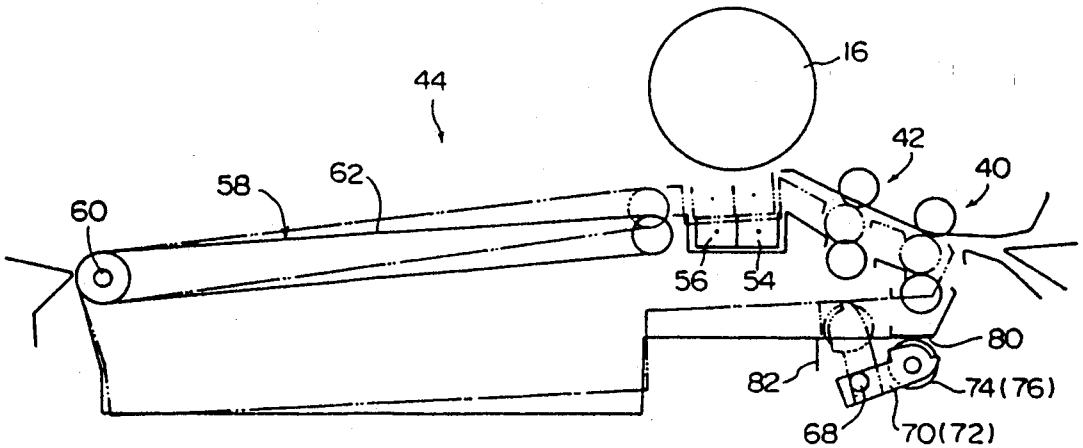
FIG. 3 is a view as seen from its side for explaining the embodiment of actions in one embodiment of the mounting and detaching unit in accordance with this invention.

As shown in FIGS. 2 and 3, the mounting and detaching means 46 include a rotating shaft 68 supported between a front side plate 64 and a rear side plate 66 in the conveying unit 24 and mounting and detaching levers 70 and 72 fixed to the rotating shaft 68. In this example, the mounting and detaching levers are composed of a pair of levers 70 and 72 arranged with a space in the axial direction of the rotating shaft 68 and facing each other in an axial direction. At the end portion of each lever, rollers 74 and 76 are provided so that they can rotate. One end of the rotating shaft 68 projects forwardly of the front side plate 64, and an operating lever 78 is fixed thereto. Each roller contacts and engages with the lower end surface 80 which is on the opposite side of the driving shaft 60 in the mounting and detaching unit 44, and these rollers support the lower end surface of the mounting and detaching unit 44.

At a position where the mounting and detaching levers 70 and 72 are fell down sideways, the mounting and detaching unit 44 is held at a non-set position separated downwardly (the position shown by a solid line in FIG. 3) from the image-forming unit 18 (including the image-bearing member 16). At a position where the mounting and detaching levers 70 and 72 are raised upwardly, the mounting and detaching unit 44 is held at a set position (transferable position) with respect to the image-forming unit 18 (including the image-bearing member 16), namely at a set position shown at a two-dot chain line in FIG. 3. At this set position, at a position where each lever is beyond a perpendicular line with respect to the rotating shaft 68, each roller abuts with a projecting portion 82 projecting downwardly from the lower surface 80 of the end portion of the mounting and detaching unit 44, and this position is held. Selection of each of the above-mentioned positions of the mounting and detaching unit 44 is performed by manipulating the operating lever 78.

Between the mounting and detaching unit 44 and the rear side plate 12 of the main body of the copying machine, a locking means 84 is provided which can hamper and permit the movement of the conveying unit 24 in the drawing direction in regard to the selective movement of the above-mentioned positions of the mounting and detaching unit 44.

Figure 4:
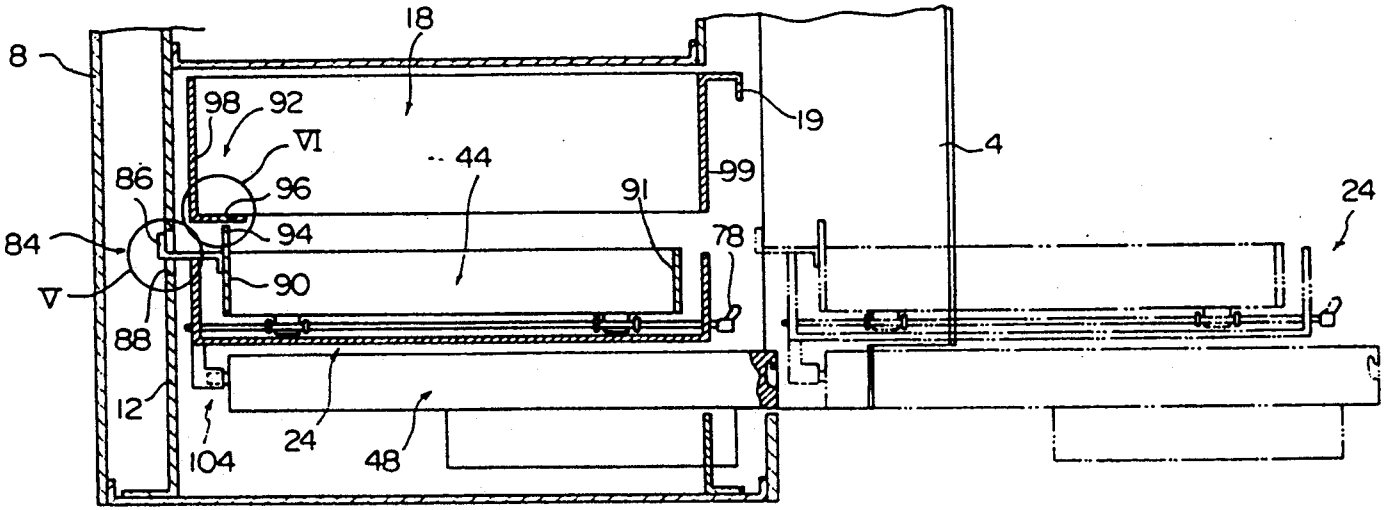
FIG. 4 is a view of another embodiment of actions in FIG. 2.
Figure 5:
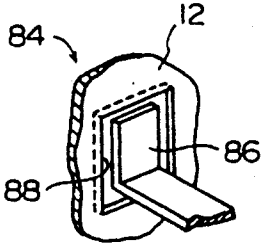
FIG. 5 is a perspective view of a V part on an enlarged scale of FIG. 4.

As shown in FIGS. 2, 4 and 5, the locking means 84 includes an engaging piece 86 provided in the mounting and detaching unit 44 and an engaging hole 88 formed in the rear side plate 12. The engaging piece 86 is composed of a member made by forming one end of a rectangular plate member in a nearly L-shape, and its other end is fixed to the rear side plate 90 of the mounting and detaching unit 44. The engaging hole 88 is formed in a rectangular hole which permits passage of the L-shaped end portion of the engaging piece 86. When the mounting and detaching member 44 is located at the set position shown in FIGS. 1 and 2, the L-shaped portion of the engaging piece 86, as shown in FIG. 2, is positioned (engages) at the uppermost site at a position past the engaging hole 88, and interferes with the rear side plate 12 above the engaging hole 88 to thereby hamper the movement of the mounting and detaching unit 44 in the drawing direction. When the mounting and detaching unit 44 is at the non-set position shown in FIG. 4, the L-shaped position of the engaging piece 86, as shown in FIGS. 4 and 5, exists in the engaging hole 88, and is positioned so as to permit movement of the mounting and detaching unit 44 in the withdrawing direction (engagement cancelled).

Between the mounting and detaching unit 44 and the image-forming unit 18, another locking means 92 is provided which can hamper and permit the movement of the image-forming unit 18 in the withdrawing direction.

Figure 6:
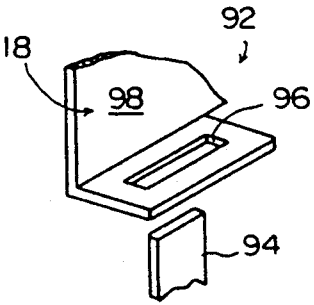
FIG. 6 is a perspective view of a VI part on an enlarged scale of FIG. 4.

The other locking means 92, as shown in FIGS. 2, 4 and 6, comprises another engaging piece 94 provided in mounting and detaching unit 44 and another engaging hole 96 formed in the image-forming unit 18. The other engaging piece 94 is composed of a nearly rectangular plate member projecting upwardly from the rear side plate 90 of the mounting and detaching unit 44. The other engaging hole 96 is formed in a portion formed by bending the lower end portion of the rear side plate 98 of the image-forming unit 18 in a L-shaped pattern and has such a shape as to permit passage of the other engaging piece 94.

When the mounting and detaching unit 44, as shown in FIGS. 1 and 2, are at the set position, the other engaging piece 94 are at the engaging position past the other engaging hole 96 as shown in FIG. 2, and the movement of the image-forming unit 18 in the drawing direction is hampered. When the mounting and detaching unit 44 is at a position separated from the image-forming unit 18 as shown in FIG. 4, the other engaging piece 94 is at such a position at which its engagement with the other engagement hole 96 is cancelled, and the movement of the image-forming unit 18 in the drawing direction is permitted. At the front side end portion of the image-forming unit 18, a handle 19 for drawing is provided.

The housing 2 of the copying machine has a cassette 48 for holding copying papers which is supported by the same pair of slide rails 100 and 102 as above so that it is drawn forwardly alone or with the conveying unit 24. A drawing handle 40 is provided in the front end portion of the cassette 48.

Between the cassette 48 and the conveying unit 24, a holding means 104 is provided which can holds the cassette 48 at a housing position (set position) or can cancel its holding. The holding means 104 is a known locking means, which, as shown conceptually in FIG. 2, is composed of a projecting piece protruding from the rear end portion of the cassette 48 toward the rear side plate 12 and a holding member provided in the corresponding rear position of the conveying unit 24 and holding the projecting piece therein. When the conveying unit 24 is locked by the rear plate 12 as stated above, the holding force of the holding means 104 is determined so that the cassette 48 can be drawn alone from the conveying unit 24 by the handle 49, or namely the holding of the holding means 104 can be cancelled. When the locking of the locking means 84 of the conveying unit 24 is cancelled, the cassette 48 can be drawn forwardly together with the conveying unit 24. The holding means 104 may be operated by a magnetic means if a required holding force can be so obtained.

As shown in FIG. 1, the cassette 48 is provided with a supporting plate **48*b* for lifting the housed paper P upwardly using a shaft 48*a* as a fulcrum. The up and down movement of the supporting plate 48*b* is performed by a lever 48*c* provided therebeneath. A motor (not shown) is linked to the shaft portion 48*d* of the lever 48*c*, and the motor rotates such that in interlocking relation to the opening and closing of the front cover 4 (6) of the copying machine, the lever 48*c* moves up and down. When the front cover is opened, the supporting plate 48*b* is lowered (where the cassette 48 can be drawn alone from the conveying unit 24). When the front cover is closed, the supporting plate 48*b* rises to make the paper P contact a paper feeding roller 50*a* of a paper feeding unit 50**.

The known paper feeding unit 50 provided in the conveying unit 24 is fixed to the front and rear side plates 64 and 66 of the conveying unit 24 by means of screws. In the paper feeding unit 50, the paper feeding roller **50*a* and a paper feeding separating device 50*b*** are provided.

In the conveying unit 24 are provided a guide plate pair 52 for guiding papers sent from the paper feeding unit 50 in the direction of the image-forming unit 18. As shown in FIG. 1, one (**52*a*) of the guide plate pair 52 is arranged outside of the other guide plate 52*b*, and in the widthwise end portion, supported by the front and rear side plates 64 and 66 of the conveying unit 24 so that it may be rotated by a shaft 52*c* via a securing plate. One guide plate 52*a* can be selectively moved, via the shaft 52*c*, to a predetermined position (set position) with respect to the other guide plate 52*b* and a non-set position separated from the other guide plate 52*b*. Between the lower portion of the guide plate 52*a* and the conveying unit 24, a holding means H is provided which can hold the guide plate 52*a*** at the set position and can permit movement of it to the non-set position. The holding means H in this embodiment is composed of a magnet means.

With respect to the image-forming unit 18 and the conveying unit 24, the housing 2 has a paper placing table 106, other cassettes 108 and 110 provided upstream of the housing 2. Furthermore, in relation to them, known paper feeding devices 112, 114 and 116 are provided. Furthermore, at the downstream site of the conveying unit 24 within the housing 2, a known fixing device 118 and a known paper-receiving table 120 are arranged.

The operation of the examples of this invention which is made up as shown above will be described on the basis of the accompanying drawings.

In FIG. 1, copying paper sheets are set in the cassette 48, the table 106, and other cassettes 108 and 110, and are sent out in the direction of the image-bearing member 16 according to the respective purposes. For example, when copying is performed on paper set in the cassettes 48, by a switching operation (not shown), the paper P passes through the paper feeding unit 50, the guide plates pair 52, the roller pairs 40 and 42, and then between the image-bearing member 16 and the transferring charger 54 and the separation charger 56. After the image is transferred to the paper P, it is sent to the fixing device 118 by a conveying belt 62. The image is heated and fixed, and the paper P is sent out to a paper-receiving table 120. Since the transferring step of paper from the other cassette 108, etc. is the same as the transferring step of paper from the cassette 48, its explanation will be omitted.

When during transfer of an image to paper, jamming of paper occurs, various parts which act during the transfer such as the rollers, the image-bearing member 16 and the conveying belt device 58 will be automatically stopped. At the same time, this stoppage is displayed.

When jamming is to be disposed of, the user first opens the front covers 4 and 6 of the copying machine forwardly to himself (see FIG. 11) in accordance with the indication of the display. Next, an operating lever 78 provided in the conveying unit 44 is turned down in the right direction in FIG. 11. As shown in FIG. 3, the rollers 74 and 76 of the mounting and detaching levers 70 and 72 are rolled along the under surface of the mounting and detaching unit 44, and fallen laterally. As a result, the mounting and detaching unit 44 is moved to the solid-line position in FIG. 3, namely to the non-set position. The L-shaped part of the engaging piece 86 of the locking means 84, as shown in FIGS. 4 and 5, moves downwardly within the engaging hole 88, and is positioned at a position which permits movement (passage) in the withdrawn direction of the mounting and detaching unit 44. The other engaging piece 94 of the other locking means 92, as shown in FIGS. 4 and 6, is moved to a position at which penetration through the other engaging hole 96 is cancelled.

Figure 7:
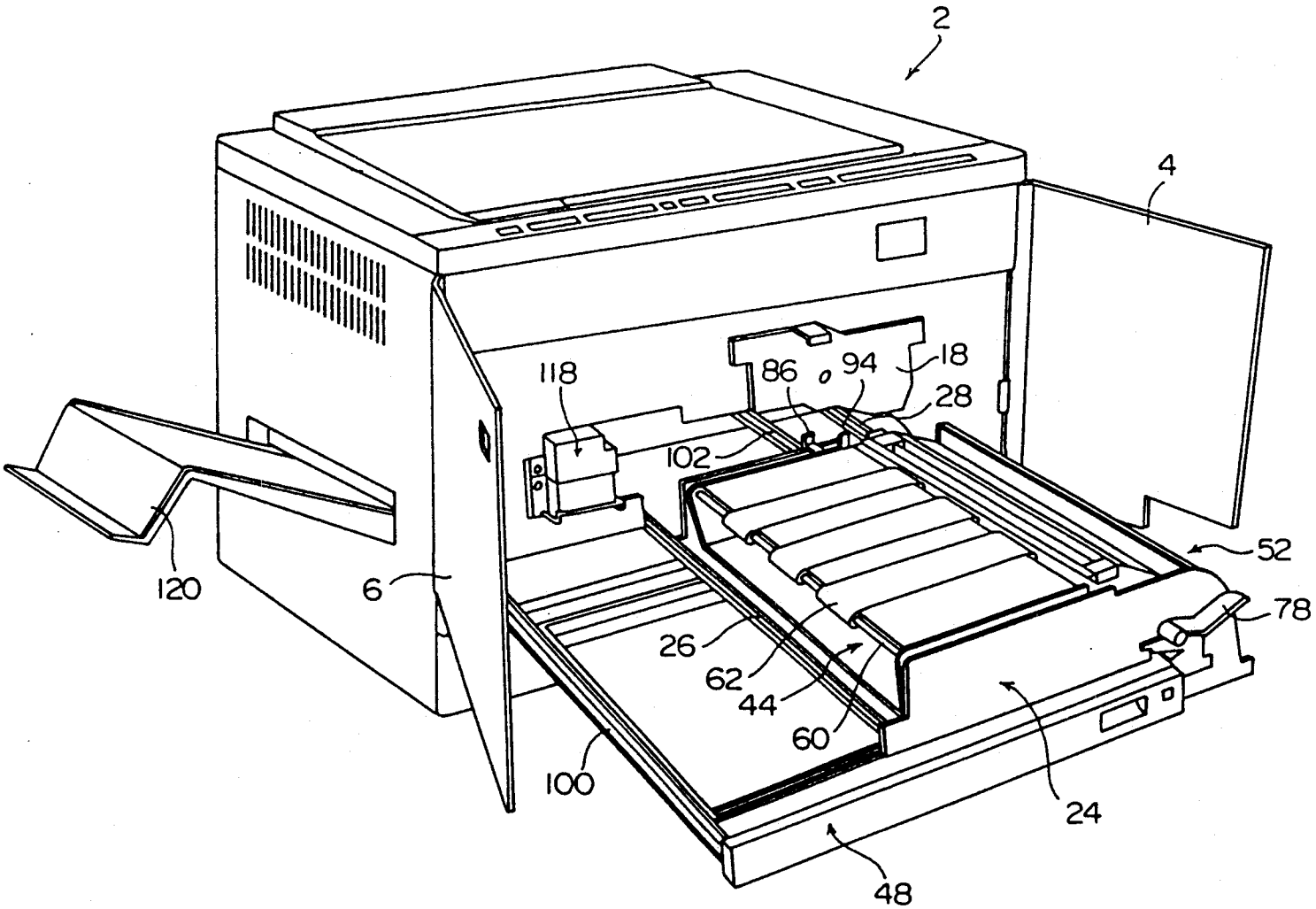
FIG. 7 is a perspective view of an embodiment of actions in FIG. 4.

If in this state, the operating lever 78 of the conveying unit 24 is pulled forwardly, the conveying unit 24 together with the mounting and detaching unit 44 and the cassettes 48 can be integrally drawn forwardly from the main body of the copying machine along the slide rails 26, 28, 100 and 102 (see FIGS. 4 and 7). The cassette 48 in this case moves together with the conveying unit 24 along the slide rails 100 and 102. By utilizing a large space formed below the image-forming unit 18, the user can properly dispose of jamming.

When paper jams up between guide plate pairs 52, jamming can be disposed of in front of the main body of the copying machine by opening the outside guide plate 52*a* to the non-set position at a position where the conveying unit 24 is drawn.

After the jamming is disposed of, when the guide plate 52*a* is returned to the original set position, its set position is held by the holding means H. Then, the conveying unit 24, together with the cassette 49, is moved to the original position in the main body of the machine and the operating lever 78 is raised. The L-shaped part of the engaging piece 86 of the locking means 84, as shown in FIG. 2, engages the uppermost part of the engaging hole 88 at a position past the engaging hole 88 so that as stated hereinbefore, the movement of the mounting and detaching unit 44, i.e. the conveying unit 24, in the drawing direction is hampered. At the same time, the mounting and detaching unit 44 is held at the set position with respect to the image-forming unit 18.

Figure 8:
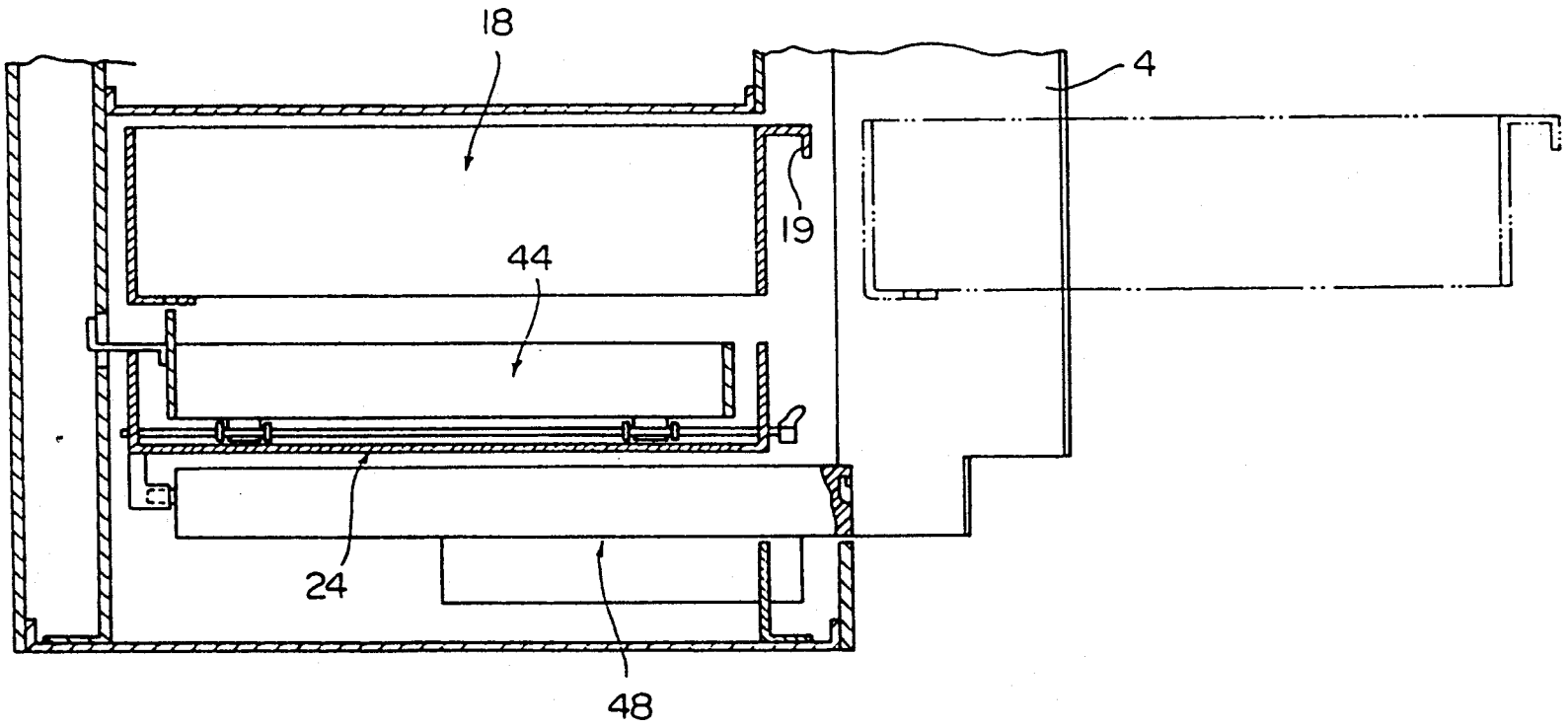
FIG. 8 is a perspective view of another embodiment of actions in FIG. 4.
Figure 9:
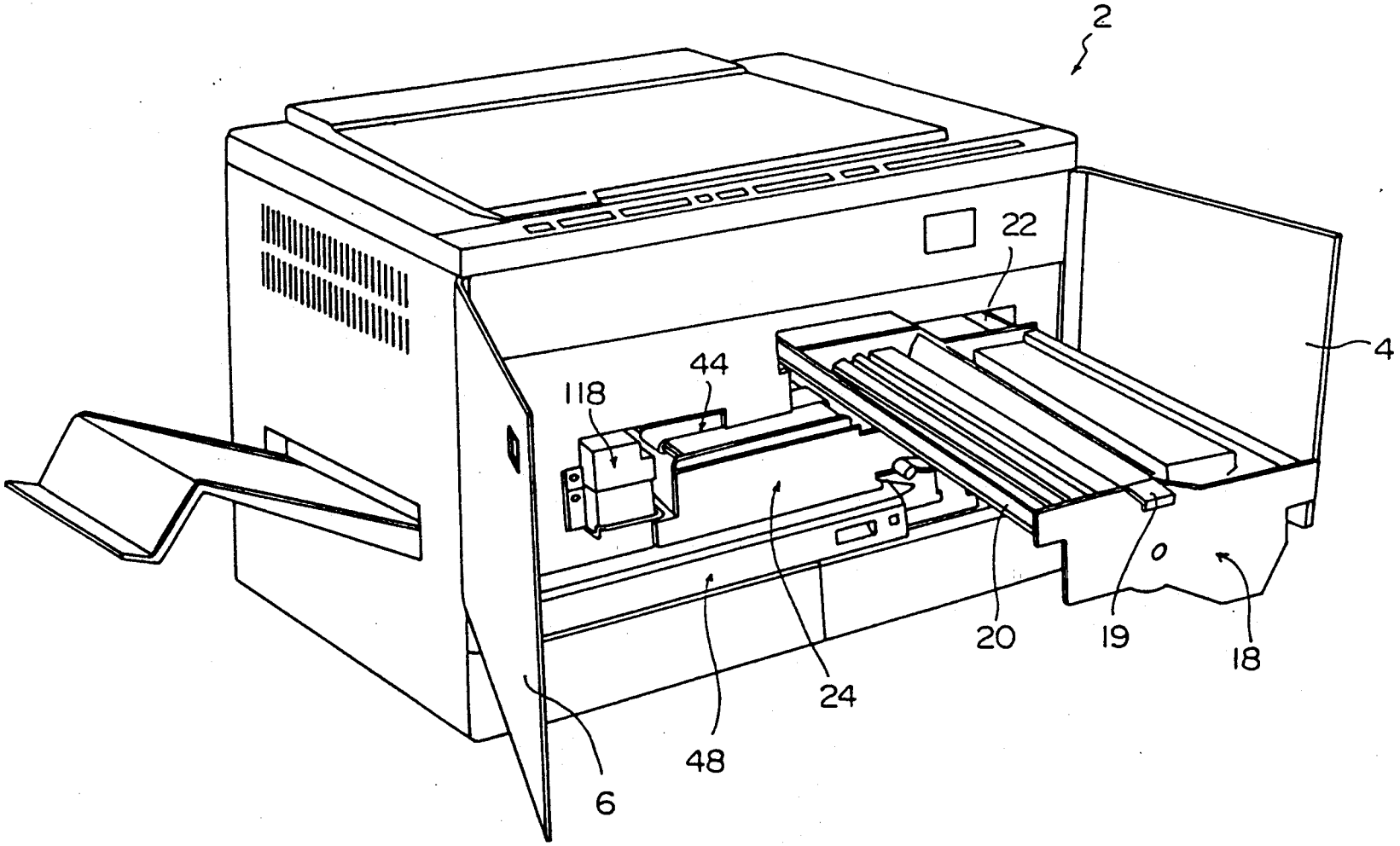
FIG. 9 is a perspective view showing the embodiment of actions in FIG. 8.

When the image-forming unit 18 is withdrawn alone from the main body of the copying machine for supplying of a toner and maintenance and otherwise, the operating lever 78 is brought down laterally as stated above. Then the other engaging piece 94 of the other locking means 92 moves to a position where penetration into the other engaging hole 96 is cancelled, as shown in FIGS. 4 and 6. Thus, by the handle 19, the image-forming unit 18 alone can be drawn along the slide rails 20 and 22 (see FIGS. 8 and 9). If the image-forming unit 18 is returned to the original position in the main body of the copying machine and the operating lever 78 is raised to the set position, the other engaging piece 94 of the other locking means 92 is held at an engaged position at which the other engaging piece 94 penetrates through the other engaging hole 96. The image-forming unit 18 is held at the original set position.

Figure 10:
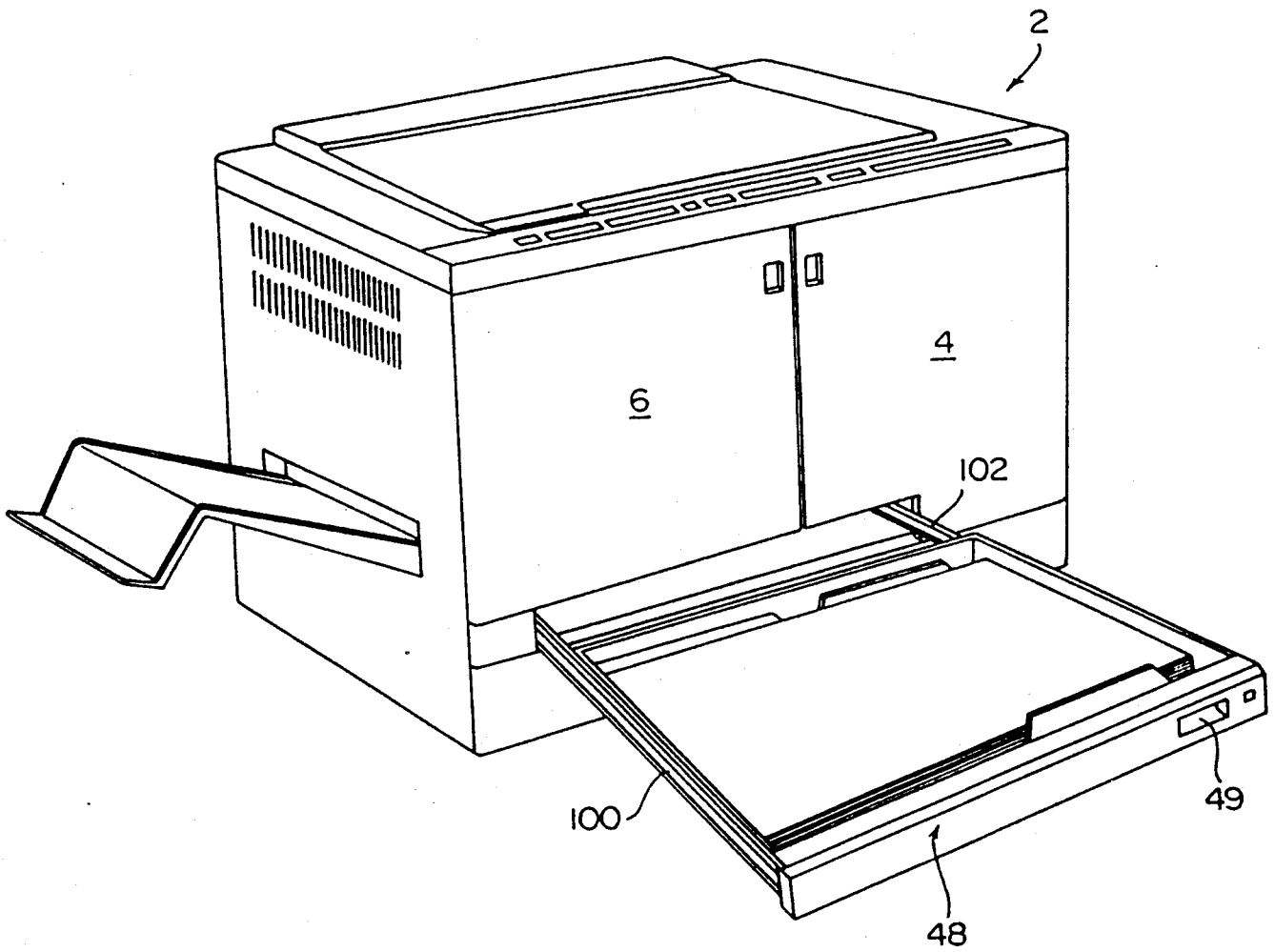
FIG. 10 is a perspective view showing an embodiment of actions in FIG. 2.

When for paper supply or otherwise the cassette 48 is to be drawn alone from the main body of the copying machine, the cassette 48 is pulled forwardly by the handle 49 while the conveying unit 24 is locked in the main body of the copying machine by the locking means 84. Then, as stated above, the holding of the holding means 104 is cancelled. Accordingly, only the cassette 48 can be drawn from the main body of the copying machine along the slide rails 100 and 102 (see FIGS. 2 and 10). If the cassette 48 is conversely moved into the main body of the copying machine, the holding means 104 functions to hold the cassette 48 at the set position.

FIGS. 12 to 17 shows another embodiment of this invention in which the conveying unit 24 of the electrostatic copying machine is provided with a residual toner recovery container 130. This other embodiment has substantially the same structure as the copying machine shown in FIGS. 1 to 11 excepting portions related to the residual toner recovering container 130. Accordingly, the same parts of the copying machines are represented by the same reference numerals as shown in FIGS. 1 to 11, and only the different parts will be further described.

Figure 12:
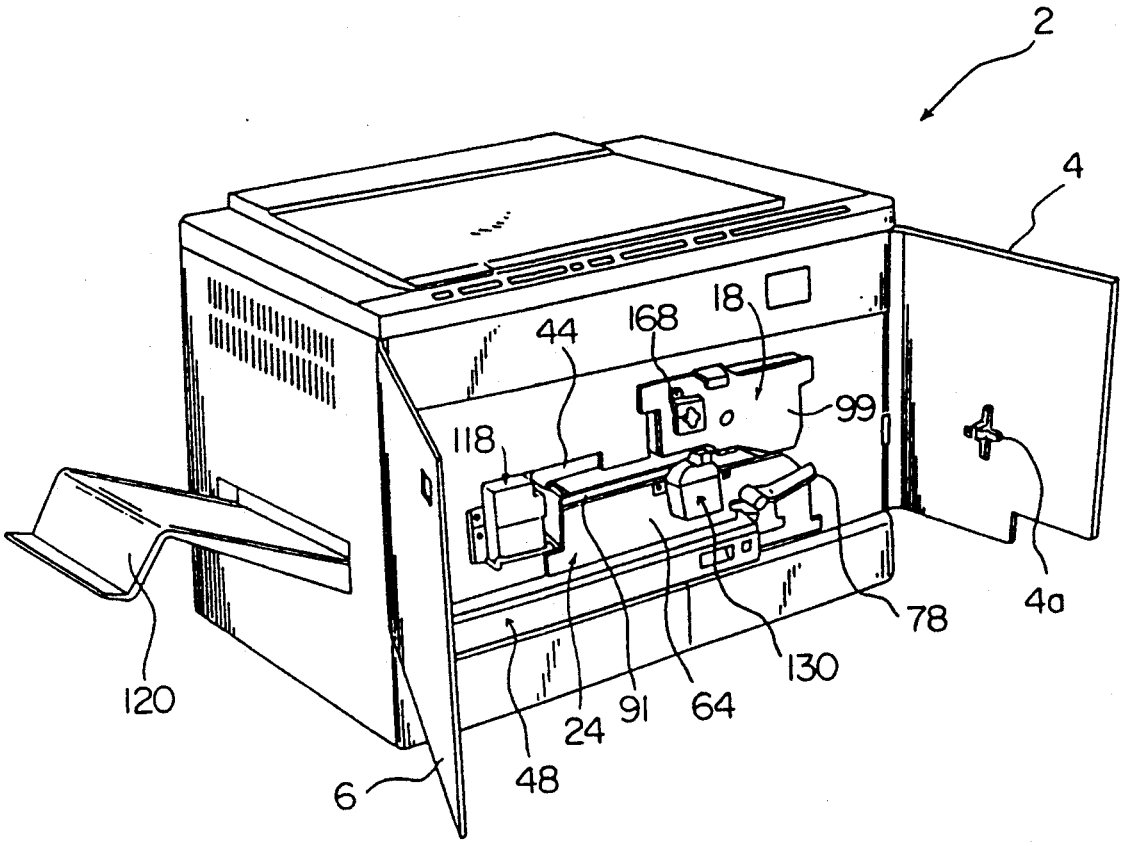
FIG. 12 is a perspective view of one embodiment of actions in an electrostatic copying machine including other embodiments of this invention.
Figure 13:
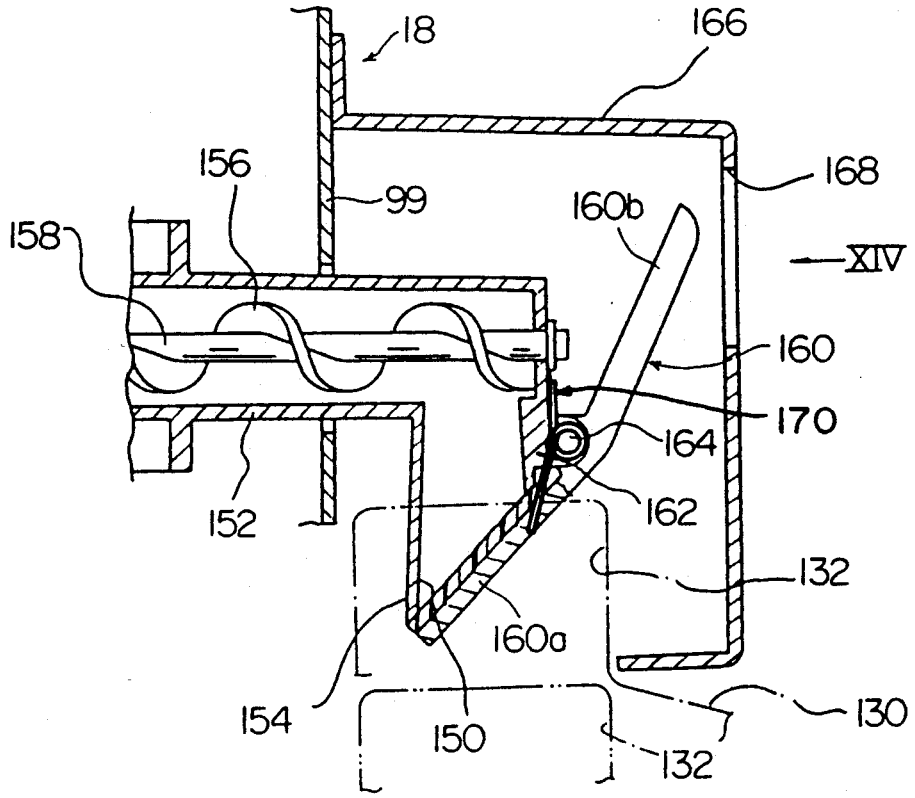
FIG. 13 is a rough sectional view showing a part of FIG. 12.

FIG. 12 shows the state where the front covers 4 and 6 of the housing 2 which is the main body of the copying machine are in the open state. It is understood from FIG. 12 the state in which the residual toner recovery container 130 is mounted on the conveying unit 24. FIG. 13 shows the positional relation of the residual toner recovery container 130 to a residual toner discharge opening 150 provided in the image-forming unit 18.

Figure 14:
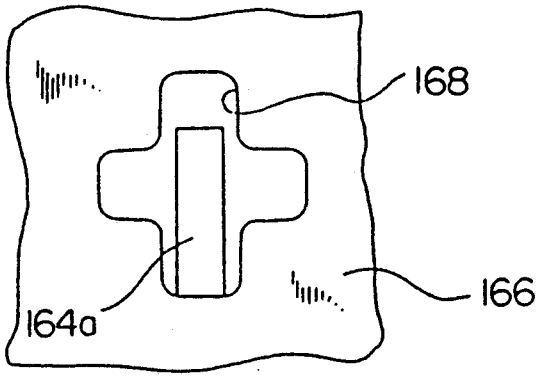
FIG. 14 is a view taken in the direction of arrow XIV of FIG. 13.

First, with reference to FIGS. 12 to 14, the residual toner discharge opening 150 will be described. As shown in FIG. 13, the forward end portion of a toner discharging tube 152 extends ahead of a front side plate 99 of the image-forming unit 18 (to the right of FIG. 13 and toward the side of the front covers 4 and 6 of the housing 2 in FIG. 12). The forward end portion of the toner discharge tube 152 further has a projecting portion 154 extending further downwardly. The residual toner discharge opening 150 is formed at the lower end portion of the projecting portion 154.

The toner discharge tube 152 extends rearwardly of the image-forming unit 18 (to the left in FIG. 13) and is connected to a cleaning device (not shown). Within the toner discharge tube 152 is rotatably supported a rotating shaft 158 having a helical fin 156. Hence, the residual toner recovered from the image-bearing member by the cleaning device is conveyed by the fin 156 to the projecting portion 154 of the toner discharge tube 152, and discharged downwardly from the residual toner discharge opening 150.

The projecting portion 154 supports a closure body 160 at a bracket 162 provided in the projecting portion 154 rotatably via pin 164. A closure 160*a* opening and closing the residual toner discharge opening 150 is formed on one side of the closure body 160 with respect to the pin 164. An elastic means 170, specifically a torsion spring is mounted around the pin 164. This spring acts between the closure body 160 and the projecting portion 154 to urge the closure 160*a* to close the residual toner discharge opening 150. On the other side of the closure body 160 with respect to the pin 164, there is formed an operating section 160*b* positioned so that it projects ahead of the projecting portion 154 in the state where the closure 160*a* closes the residual toner discharge opening 150.

Ahead of the front side plate 99 of the image-forming unit 18, a cover 166 is secured to cover the projecting portion 154, the closure body 160 and an opening portion 132 provided above the residual toner recovery container 130. That part of the cover 166 which is opposite to the operating section 160*b* of the closure body 160 has formed therein a cross opening 168 shown in FIG. 14.

On the other hand as shown in FIG. 12, at the back of the front cover 4, there is provided a protrusion 4*a* which can be inserted through the opening 168 when the front cover 4 is closed. In the state where the front cover 4 is closed, the protrusion 4*a* is inserted through the opening 168 and abuts against and presses the operating section 160*b* to revolve the closure body 160 around the pin 164 and open the residual toner discharge opening 150.

Figure 15:
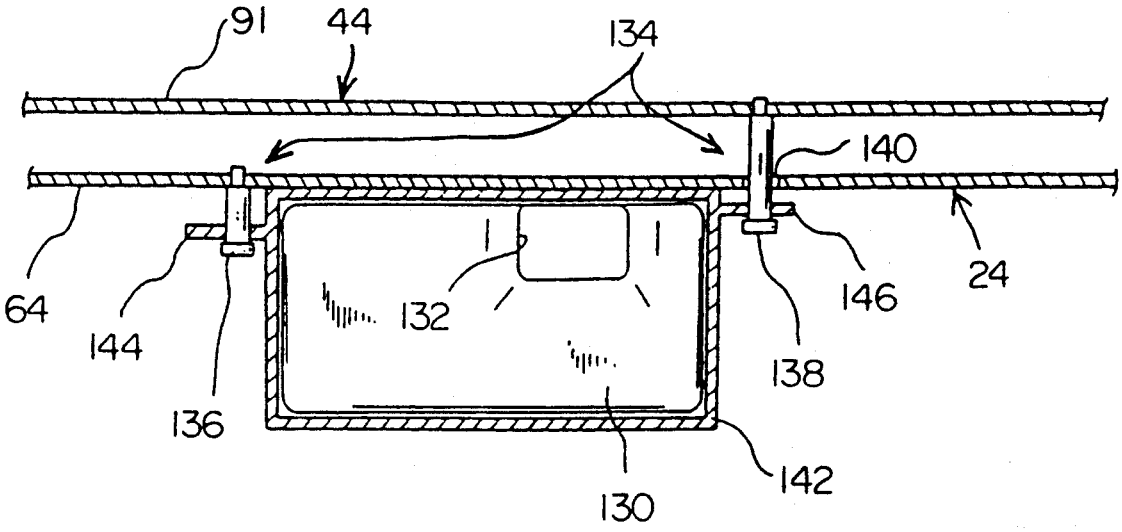
FIG. 15 is a sectional view of other parts of FIG. 12.
Figure 16:
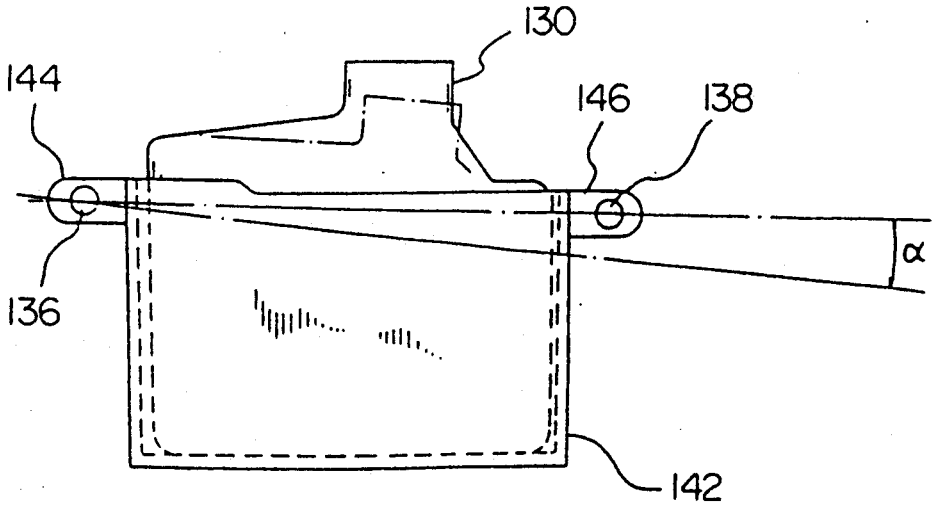
FIG. 16 is a rough front view for illustrating the actions in FIG. 15.

Now, the residual toner recovery container 130 supported on the conveying unit 24 will be described with reference to FIGS. 15 and 16.

The residual toner recovery container 130 is supported on the conveying unit 24 by a supporting means 134. The supporting means 134 includes a first pin 136 fixed to the front side plate 64 of the conveying unit 24 and projecting ahead of the front side plate 64 and a second pin 138 fixed to the front side plate 91 of the mounting and detaching unit 44 and projecting ahead of the front side plate 64 through a long hole 140 formed in the front side plate 64 of the conveying unit 24.

In this embodiment, the residual toner recovery container 130 having an opening portion 132 formed at its upper portion is accommodated in a container 142 mountably and detachably. The container 142 is opened at its upper portion, and is supported in the forward portion of the front side plate 64 of the conveying unit 24.

Flanges 144 and 146 are formed on both sides of the container 142. Engaging holes are formed in these flanges 144 and 146 and the first pin 136 and the second pin 138 are inserted through the engaging holes. The engaging holes of the flanges 144 and 146 are rotatable with respect to the first pin 136 and the second pin 138.

Accordingly, the container 142 is supported rotatably at its one side portion by the front side plate 64 of the conveying unit 24 via the first pin 136, and supported rotatably at its other side portion by the front side plate 91 of the mounting and detaching unit 44 via the second pin 138. Since the residual toner recovery container 130 is accommodated in the container 142, it results that one side portion of the residual toner recovery container 130 is supported rotatably by the front side plate 64 of the conveying unit 24 via the first pin 136, and its other side portion is supported rotatably by the front side plate 91 of the mounting and detaching unit 44 via the second pin 138.

The opening portion 132 is provided above the residual toner recovery container 130.

The operation of another embodiment of this invention described above will be described.

When the mounting and detaching unit 44 is at the set position shown by a two-dot chain line in FIGS. 2 and 3 and in the state where the front covers 4 and 6 are closed and its copying operation is possible, the protrusion 4*a* of the back surface of the front cover 4 abuts against, and presses, the operating section 160*b* of the closure body 160 through the opening 168 of the cover 166. By this, the closure body 160 is rotated around the pin 164, and the closure 160*a* opens the residual toner discharge opening 150. On the other hand, the residual toner recovery container 130 exists at the solid line position in FIG. 16, and the opening portion 132 formed above it, as shown by the one-dot chain line in FIG. 13, is positioned at a residual toner recovery position connected to the residual toner discharge opening 150.

Accordingly, the residual toner conveyed from the cleaning device via the fin 156 at the time of copying is recovered into the residual toner recovery container 130 from the residual toner discharge opening 150.

When at the time of disposing of jamming, the front covers 4 and 6 in the housing 2 are opened as shown in FIG. 12, the pressing of the operating section 160*b* by the protrusion 4*a* is cancelled. As a result, the residual toner discharge opening 150 is closed by the closure 160*a* (see FIG. 13). Then, the mounting and detaching unit 44 is revolved around the driving shaft 60 by the operating lever 78 to move the mounting and detaching unit 44 to a non-set position shown by a solid line in FIGS. 3 and 4.

By this movement, the front side plate 91 of the mounting and detaching unit 44 moves downwardly. The second pin 138 fixed to the front side plate 91 moves downwardly along the long hole 140 of the front side plate 64 of the conveying unit 24. The residual toner recovery container 130, together with the container 142, revolves downwardly clockwise by an angle of $\alpha$ degrees (for example, $\alpha$=about 4 degrees) using the first pin 136 as an axis (see FIG. 16). As a result, the residual toner recovery container 130, or its opening portion 132, is positioned at a retired position separated from the residual toner discharge opening 150 (the position shown by a two-dot chain line in FIG. 13 and the position shown by a one-dot chain line in FIG. 16).

Figure 17:
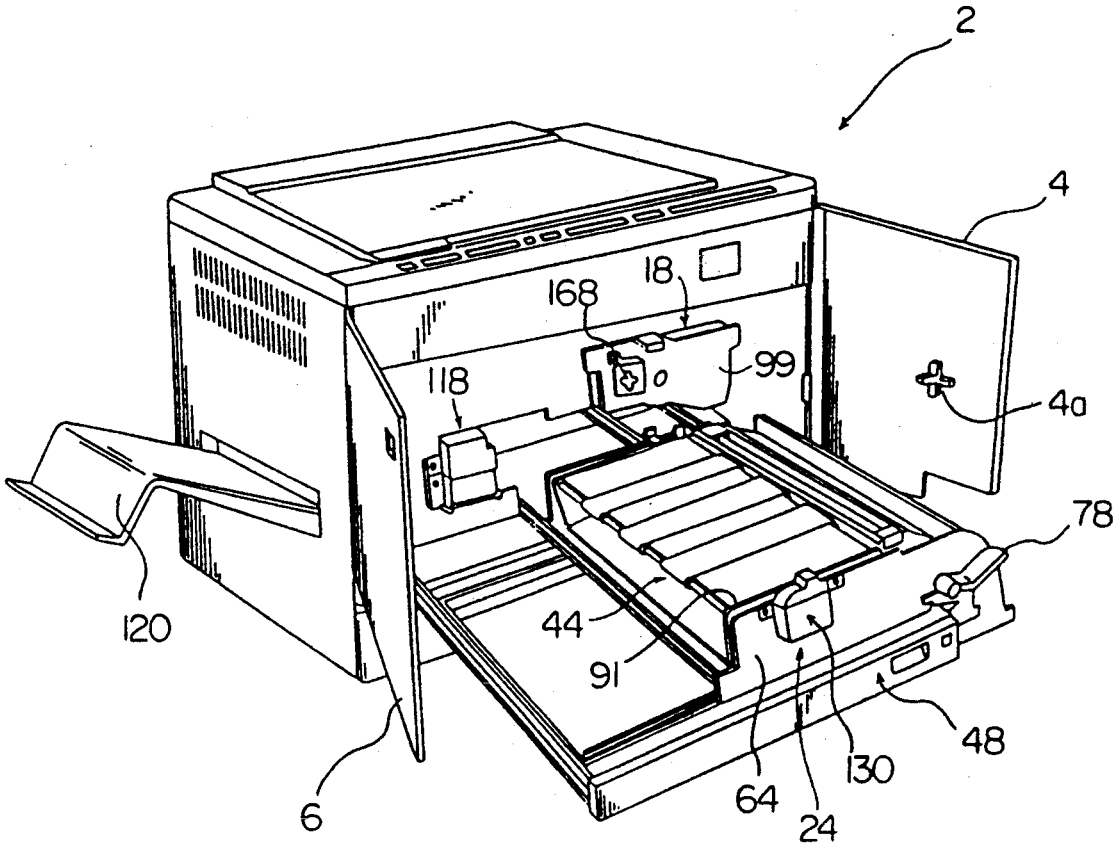
FIG. 17 is a view showing another embodiment of actions in FIG. 12.

If in this state the operating lever 78 of the conveying unit 24 is pulled forwardly, the conveying unit 24, together with the residual toner recovery container 130, can be drawn forwardly (see FIG. 17).

After the jamming is disposed of, the conveying unit 24 is pushed to the original position within the main body of the copying machine, and the mounting and detaching unit 44 is moved to the set position. Then, by the reverse operations to those stated above, the residual toner recovery container 130 revolves the first pin 136 above the shaft counterclockwise. The residual toner recovery container 130 is returned to the residual toner recovery position shown by the one-dot chain line in FIG. 13 and the solid line shown in FIG. 15. When the front covers 4 and 6 are closed, by the reverse operations to those mentioned above, the closure 160*a* opens the residual toner discharge opening 150.

The effects of the present invention described hereinabove with reference to the specific embodiments described hereinabove will be described with reference to the copying machine described herein and illustrated in the accompanying drawings.

(1) Mounting and detaching unit provided in the conveying unit is supported so that it can be moved selectively to the set position and the non-set position with respect to the image-forming unit. By cancelling the locking with respect to the main body of the copying machine in interlocking relation to this selective movement, the conveying unit can be drawn from the main body of the copying machine. Hence, a large space can be easily formed below the image-forming unit. Accordingly, in disposing of jamming, its state can be easily ascertained, and the operation of removing paper can be very easily performed. Further, since there is enough operating space, there is no fear of getting the hand injured. The maintenance itself of the conveying unit is very easy as compared with the prior art.

The conveying unit can be drawn forwardly together with the cassette, and this produces the following effects.

When a paper of a relatively large size is accommodated in a cassette positioned beneath the main body of the copying machine, any paper which jamms up is positioned over a greater portion of the paper conveying passage. However, the paper to be disposed of can be removed in its original state without tearing. Hence, when a paper of a relatively large size is used, the jamming paper can be very easily disposed of.

In this embodiment, the cassette is constructed such that together with the conveying unit, it can be drawn frontwardly integrally. When the holding means is provided between the cassette and rear side plate of the main body of the copying machine, the cassette cannot be drawn alone by itself, and cannot be drawn forwardly together with the conveying unit. In this case, too, the conveying unit itself is drawn from the main body of the copying machine. Accordingly, the above space is formed especially in a larger size than in the conventional device, and the above operability is greatly improved.

(2) By the above movement of the conveying unit, the conveying belt device positioned in proximity to the fixing device can be drawn together with the conveying unit. Accordingly, a large space is formed also near the fixing device, even if paper bites into the fixing device, the disposability of the jamming at this part which was especially difficult is improved extremely well.

(3) Since the outside guide plate of the guide plate pair can be moved to the non-set position at a position to which the conveying unit is drawn forwardly of the main body of the copying machine, the disposability of the jamming in the guide plate pair is markedly increased.

(4) Since in interlocking relation of the selective movement of the mounting and detaching unit, locking means operates simultaneously between the main body of the copying machine and the conveying unit, and between the conveying unit and the image-forming unit, locking and cancelling of locking can be carried out by one touch, and the locking device can be simplified, and the locking operation can be made easy.

(5) In an embodiment where a residual toner recovery container for recovering a residual toner discharged from the residual toner discharge opening is supported on the conveying unit, the residual toner recovery container, in interlocking relation to the selective movement of the mounting and detaching unit, is positioned at the residual toner recovery position or the retired position. Accordingly, the conveying unit can be drawn from the main body of the copying machine without the residual toner recovery container constituting an obstacle thereto.

Therefore, even when the residual toner recovery container is provided in the conveying unit, the disposability of jamming can be markedly improved.

(6) In the example (5) stated above, every time the jamming is disposed of, the residual toner recovery container is moved up and down in interlocking relation to the movement of the mounting and detaching unit, and the heap of the toner recovered in its inside becomes flattened. Accordingly, it is not necessary to separately provide a vibration device for vibrating the residual toner recovery container to flatten it.

While the present invention has been described with reference to the embodiments described and shown herein, it should be understood that the present invention should not be limited to these embodiments, and it may be modified or changed within the scope and spirit of the invention.

What is claimed is:

1. A conveying unit in an image-forming machine comprising an image-forming unit supported on the main body of the image-forming machine, and a conveying unit disposed opposite to the image-forming unit, said conveying unit being supported on the main body of the image-forming machine so that it can be drawn from the main body of the image-forming machine, said conveying unit supporting a mounting and detaching unit so that it is supported selectively movably at a set position or a non-set position with respect to the image-forming unit, a locking means being provided between the mounting and detaching unit and the main body of the image-forming machine for hampering or permitting the movement of the conveying unit in the drawing direction in interlocking relation to the selective movement of the mounting and detaching unit, wherein the mounting and detaching unit is provided with a paper conveying means including a driving shaft to be driven by a driving means, and the mounting and detaching unit is supported by the conveying unit so that it can be moved selectively using the driving shaft as a fulcrum.

2. A conveying unit in an image-forming machine comprising an image-forming unit supported on the main body of the image-forming machine, and a conveying unit disposed opposite to the image-forming unit, said conveying unit being supported on the main body of the image-forming machine so that it can be drawn from the main body of the image-forming machine, said conveying unit supporting a mounting and detaching unit so that it is supported selectively movably at a set position or a non-set position with respect to the image-forming unit, a locking means being provided between the mounting and detaching unit and the main body of the image-forming machine for hampering or permitting the movement of the conveying unit in the drawing direction in interlocking relation to the selective movement of the mounting and detaching unit, wherein the conveying unit is provided with a mounting and detaching means for moving the mounting and detaching unit selectively, and wherein said mounting and detaching means is supported on the conveying unit and includes a rotating shaft having an operating lever fixed to its one end, and a mounting and detaching lever fixed to the rotating shaft, the end portion of the mounting and detaching lever having provided therein a roller, said roller being in contact and engaged with the under surface of the mounting and detaching unit.

3. A conveying unit in an image-forming machine comprising an image-forming unit supported on the main body of the image-forming machine, and a conveying unit disposed opposite to the image-forming unit, said conveying unit being supported on the main body of the image-forming machine so that it can be drawn from the main body of the image-forming machine, said conveying unit supporting a mounting and detaching unit so that it is supported selectively movably at a set position or a non-set position with respect to the image-forming unit, a locking means being provided between the mounting and detaching unit and the main body of the image-forming machine for hampering or permitting the movement of the conveying unit in the drawing direction in interlocking relation to the selective movement of the mounting and detaching unit, wherein the locking means includes an engaging piece provided in the mounting and detaching unit and an engaging hole provided in the main body of the image-forming machine, said engaging piece, when the mounting and detaching unit is at the set position, engages the engaging hole to hamper the movement of the conveying unit in the drawing direction, and when the mounting and detaching unit is at the non-set position, the engagement of the engaging piece with the engaging hole is cancelled to permit the movement of the conveying unit in the drawing direction.

4. The conveying unit of the image-forming machine according to claim 3, wherein the engaging piece is formed nearly in an L-shape.

5. A conveying unit in an image-forming machine comprising an image-forming unit supported on the main body of the image-forming machine, and a conveying unit disposed opposite to the image-forming unit, said conveying unit being supported on the main body of the image-forming machine so that it can be drawn from the main body of the image-forming machine, said conveying unit supporting a mounting and detaching unit so that it is supported selectively movably at a set position or a non-set position with respect to the image-forming unit, a locking means being provided between the mounting and detaching unit and the main body of the image-forming machine for hampering or permitting the movement of the conveying unit in the drawing direction in interlocking relation to the selective movement of the mounting and detaching unit, wherein the image-forming unit is supported so that it can be alone drawn from the main body of the image-forming machine, and between the mounting and detaching unit and the image-forming unit, another lock means is provided so that in interlocking relation to the selective movement of the mounting and detaching unit, it hampers and permits the movement of the image-forming unit in the drawing direction.

6. The conveying unit of the image-forming machine according to claim 5 wherein the other locking means includes another engaging piece provided in the mounting and detaching unit and another engaging hole provided in the image-forming unit, said other engaging piece, when the mounting and detaching unit is at the set position, comes into engagement with the other engaging hole of the image-forming unit to hamper the movement of the image-forming unit in the drawing direction, and when the mounting and detaching unit is at the non-set position, the other engaging piece is disengaged from the other engaging hole to permit the movement of the image-forming unit in the drawing direction.

7. The conveying unit of the image-forming machine according to claim 6 wherein said other engaging piece of the mounting and detaching unit is formed of a plate-like member.

8. A conveying unit in an image-forming machine comprising an image-forming unit supported on the main body of the image-forming machine, and a conveying unit disposed opposite to the image-forming unit, said conveying unit being supported on the main body of the image-forming machine so that it can be drawn from the main body of the image-forming machine, said conveying unit supporting a mounting and detaching unit so that it is supported selectively movably at a set position or a non-set position with respect to the image-forming unit, a locking means being provided between the mounting and detaching unit and the main body of the image-forming machine for hampering or permitting the movement of the conveying unit in the drawing direction in interlocking relation to the selective movement of the mounting and detaching unit, wherein the image-forming machine supports a cassette for holding papers so that the papers may be drawn, a holding means being provided between the cassette and the conveying unit which can hold, and does not hold, the cassette at the set position, and when the lock means provided between the mounting and detaching unit and the main body of the image-forming machine is cancelled, the cassette is drawn integrally with the conveying unit from the main body of the image-forming machine.

9. The conveying unit of the image-forming machine according to claim 8 wherein when the lock means is in the locked state and the holding means is cancelled, the cassette can be drawn alone from the image-forming machine.

10. The conveying unit of the image-forming machine according to claim 8 wherein said conveying unit has provided therein a paper feeding unit for feeding papers accommodated in said cassette and a pair of guide plates for guiding the papers sent from the paper feeding unit in the direction of the image-forming unit, one of said pair of guide plates being supported so that it can move selectively to the set position and the non-set position with respect to the other, and between one of said pair of guide plates and the conveying unit, a holding means is provided which can hold, and cancel the holding of, one of said guide plates at and from the set position.

11. A conveying unit in an image-forming machine comprising an image-forming unit supported on the main body of the image-forming machine, and a conveying unit disposed opposite to the image-forming unit, said conveying unit being supported on the main body of the image-forming machine so that it can be drawn from the main body of the image-forming machine, said conveying unit supporting a mounting and detaching unit so that it is supported selectively movably at a set position or a non-set position with respect to the image-forming unit, a locking means being provided between the mounting and detaching unit and the main body of the image-forming machine for hampering or permitting the movement of the conveying unit in the drawing direction in interlocking relation to the selective movement of the mounting and detaching unit, wherein the image-forming unit has provided therein a residual toner discharge opening for discharging a residual toner recovered from the image-bearing member by the cleaning device, and said conveying unit has a residual toner recovery container for recovering the residual toner discharged from the residual toner discharge opening of the image-forming unit, said residual toner recovery container being supported by a supporting means and being constructed such that in interlocking relation to the selective movement of the mounting and detaching unit, the residual toner recovery container is positioned between a residual toner recovery position connected to the residual toner discharge opening and a retired position separated from the residual toner discharge opening.

12. The conveying unit of the image-forming machine according to claim 11 wherein said supporting means includes a first pin provided in a front side plate of the conveying unit and protruding forwardly thereof and a second pin provided in a front side plate of the mounting and detaching unit and projecting forwardly of the front plate of the conveying unit through a long hole formed in the front side plate of the conveying unit, the residual toner recovery container is supported rotatably at one side portion by the front side plate of the conveying unit via the first pin and at the other side portion rotatably by the front side plate of the mounting and detaching unit via the second pin, and in interlocking relation to the selective movement of the mounting and detaching unit, the second pin moves within the long hole, whereby the residual toner recovery container revolves around the first pin between the residual toner recovery position and the retired position.

13. The conveying unit, of the image-forming machine according to claim 12 wherein the residual toner recovery container is mountably and detachably accommodated in a container disposed ahead of the front side plate of the conveying unit, one side portion of the container being supported by the first pin and the other side portion being supported by the second pin.

14. The conveying unit of the image-forming machine according to claim 11 wherein the residual toner discharge opening is formed at the lower end portion of a projecting portion extending ahead of the front side plate of the image-forming unit and further downwardly, the residual toner conveying container has formed an opening at its upper portion, and said opening is constructed such that it is connected to the residual toner discharge opening at the residual toner recovery position of the residual toner recovery container, and is separated from the residual toner discharge opening at the retired position.

15. The conveying unit of the image-forming machine according to claim 14 wherein the closure body is supported revolvably by said projecting portion via a pin, one side, with respect to the pin, of the closure body has formed a closure which opens and closes the residual toner discharge opening of said projecting portion, said closure is urged so as to close the residual toner discharge opening by an elastic means provided between the closure body and the projecting portion, the other side of the closure body has formed therein an operating section which protrudes ahead of the projecting portion in the state where the closure closes the residual toner discharge opening, the main body of the image-forming means has provided therein front covers for opening and closing the forward portions of the image-forming unit and the conveying unit, and said covers have protrusion provided therein, when the front covers are closed, the protrusion abuts against, and presses the operating portion of the closure body to revolve the closure body around the said pin and open the residual toner discharge opening.

* * * * *